US005236756A

United States Patent [19]

Halliburton

[11] Patent Number: 5,236,756

[45] Date of Patent: Aug. 17, 1993

[54] DRAINAGE CULVERTS MADE OF SIDEWALLS FROM DISCARDED TIRES

[76] Inventor: Danny B. Halliburton, Rte. 1, Box 2800, Naylor, Mo. 63953

[21] Appl. No.: 872,626

[22] Filed: Apr. 22, 1992

[51] Int. Cl.[5] ..... B32B 3/02

[52] U.S. Cl. ..... 428/65; 428/903.3; 156/95; 206/304; 405/16; 405/21

[58] Field of Search ..... 405/16, 21, 27, 30; 428/65, 188, 903.3, 36.9, 64; 156/95; 206/304, 304.2; 83/951

[56] References Cited

U.S. PATENT DOCUMENTS

| | | | |
|---|---|---|---|
| 3,547,258 | 12/1970 | Black | 206/304 |
| 3,928,701 | 12/1975 | Roehner | 405/16 X |
| 4,057,141 | 11/1977 | Laurie et al. | 428/903.3 X |
| 4,095,560 | 6/1978 | Laurie et al. | 206/304 X |
| 4,186,913 | 2/1980 | Raener et al. | 405/21 X |

*Primary Examiner*—Mark Rosenbaum
*Assistant Examiner*—Frances Chin
*Attorney, Agent, or Firm*—Patrick D. Kelly

[57] ABSTRACT

This invention relates to a method of using sidewalls from discarded automobile, truck, and other tires to manufacture drainage culverts. It also relates to the culverts manufactured by this process, and to assembly devices useful for assembling and holding together such culverts. These culverts are made by means of a simple cutting operation which removes both sidewalls from a discarded tire. The tread portion is made available for any other desired use, and is not further involved herein. The two sidewall portions are laid flat together and drilled with holes which allows them to be mounted on parallel bars which have been welded to a circular steel base plate having roughly the same dimensions as the sidewalls. When a suitable number of sidewalls (such as about 50 to 150) have been mounted on the bars, a steel closure plate having matching holes is slid onto the bars, pressed hard against the sidewalls using a press, and welded to the protruding bars. The protruding ends of the bars are cut off to complete the assembly of a section of culvert a meter or more long. Culvert sections made as described herein are highly durable and can be installed in any location where a smooth internal surface is not required, such as under a road or embankment.

4 Claims, 2 Drawing Sheets

DRAINAGE CULVERTS MADE OF SIDEWALLS FROM DISCARDED TIRES

BACKGROUND OF THE INVENTION

This invention involves a use for discarded automobile tires, in drainage culverts which formerly were made of concrete or corrugated metal.

It has been estimated that roughly 3 billion discarded tires from automobiles and trucks litter the American landscape, and 200 million more are discarded every year. Although some discarded tires are dumped offshore to create fishing reefs, that method of disposal is impractical for tires located long distances from coastlines. Most discarded tires sit in open dumps, where they collect rainwater and serve as breeding grounds for mosquitos, rats, and other pests. More information on various problems relating to the disposal or recycling of discarded tires is contained in the introductory section of U.S. Pat. No. 4,726,530 (Miller and Priscu 1988).

One object of the subject invention is to provide a simple, convenient, and inexpensive use for sidewalls from discarded tires. The sidewalls can be obtained from discarded tires by means of a simple cutting operation, which leaves the tread for other recycling uses.

Another object of this invention is to disclose a method of manufacturing sturdy and long-lasting drainage culverts which do not utilize concrete (which tends to break and crumble over time) or exposed steel (which corrodes, particularly in acidic soils; even if treated with expensive galvanizing or coating techniques, such corrosion remains a constant problem).

Another object of this invention is to disclose a highly economical and useful way to overcome a major solid waste disposal problem.

These and other objects will become apparent from the following description of the invention.

SUMMARY OF THE INVENTION

This invention relates to a method of using sidewalls from discarded automobile, truck, and other tires to manufacture drainage culverts. It also relates to the culverts manufactured by this process, and to assembly devices useful for assembling and holding together such culverts. These culverts are made by means of a simple cutting operation which removes both sidewalls from a discarded tire. The tread portion is made available for any other desired use, and is not further involved herein. The two sidewall portions are laid flat together and drilled with holes which allows them to be mounted on parallel bars which have been welded to a circular steel base plate having roughly the same dimensions as the sidewalls. When a suitable number of sidewalls (such as about 50 to 150) have been mounted on the bars, a steel closure plate having matching holes is slid onto the bars, pressed hard against the sidewalls using a press, and welded to the protruding bars. The protruding ends of the bars are cut off to complete the assembly of a section of culvert a meter or more long. Culvert sections made as described herein are highly durable and can be installed in any location where a smooth internal surface is not required, such as under a road or embankment.

BRIEF DESCRIPTION, OF THE DRAWINGS

DETAILED DESCRIPTION OF THE PREFERRED EMBODIMENTS

Figure 1:
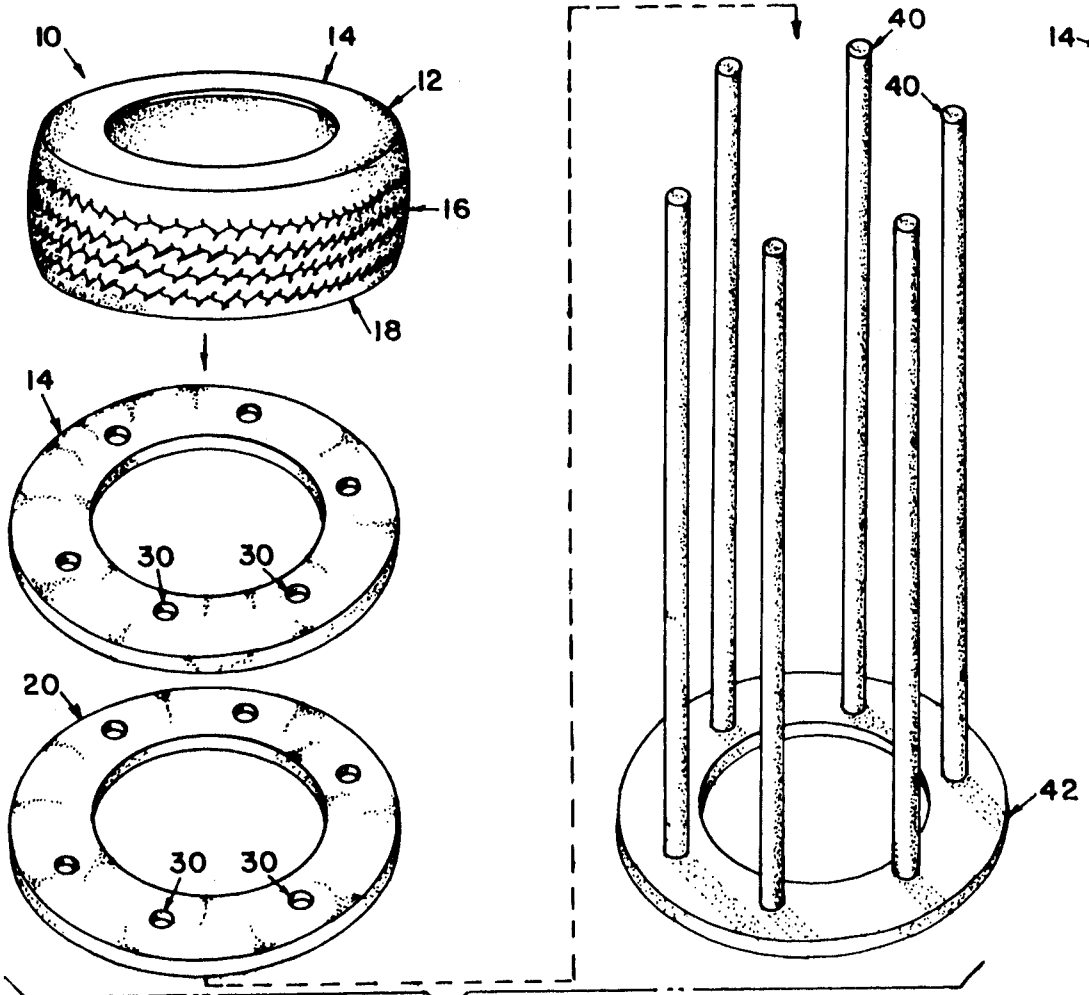
FIG. 1 shows the steps of cutting the sidewalls from a discarded tire, drilling or punching holes through the sidewalls, and mounting the sidewalls on the parallel bars welded to a base plate.

Referring to the drawings by callout number, a discarded automobile or truck tire 10 is shown in FIG. 1, prior to any cleaning, scraping, or other operations on the tire. Unlike operations which involve efforts to extract rubber from discarded tires or to grind tires into particles for subsequent molding operations which involve adhesive, it frequently will not be necessary to treat or clean discarded tires in any way prior to using them as described herein. Tires can be used for the purposes of this invention so long as they have any substantial degree of structural integrity, even if they have been sitting in open dumps for years. They can be sprayed off with water from a standard hose if desired, to remove any loose dirt, but for at least some uses, they generally do not need to be scraped or cleaned even if coated with a layer of grease.

However, it may be advisable in some situations to classify tires into different categories depending on whether they are coated with grease. Culverts which are to be used near public waterways (such as rivers or lakes) preferably should be manufactured from tires which are not heavily greased, to avoid the generation of an oily sheen on the surface of the public waterway after a heavy rain.

Discarded tire 10 is cut, using a circular cut adjacent to outer rim 12, to remove sidewall 14 (or a substantial portion thereof), by cutting it away from the treaded portion of the tire. A second cut is also made adjacent to rim 18, to remove sidewall 20 from treaded portion 16. These cuts can be made in any suitable manner. If done by hand, the operator can use a hand-held saw, preferably with a reciprocating sawtooth blade rather than a chain blade as used on a chain saw, to minimize the unwanted formation of rubber particles during the cutting operation. Alternately, instead of using a hand-held saw, tires can be cut using an automated or semi-automated machine which grips a tire and creates a circular cut, either by means of a reciprocating saw-blade device or a laser device, which can move around a circular track in the machine Alternately, the cut can be made by means of a large stamping device which uses shear force to tear through the sidewall material.

When both sidewalls 14 and 20 have been removed from the tire, the treaded portion 16 is of no further interest in this particular invention. It can be used in any suitable manner, preferably in a way which involves recycling the rubber material therein. For example, U.S. Pat. No. 5,094,905 (Murray 1992) described a method of grinding tires into particles, mixing the particles with adhesive, and molding the mixture into articles such as landscaping ties. That method can be carried out using the treaded portions from discarded tires that have been cut apart as described above.

After the sidewalls 14 and 20 have been removed from the tire, sidewall 14 should be flipped over so that its cross-sectional curvature is the same as the curvature of sidewall 14; this will make both sidewalls easier to handle together, as a pair. Preferably, the convex side of both sidewalls (i.e., the outer side in an intact tire) should be facing downward during the drilling operation, while the concave side if facing upward, to minimize flexure and distortion during drilling or punching.

The next step involves creating a set of identically spaced holes 30 through both sidewalls 14 and 20, using any suitable method such as drilling or punching. This can be done by hand if desired, using a hand-held drill and a template to align the holes properly through the sidewalls. It can be done much more rapidly and efficiently using a device known in manufacturing as a jig, which involves making all of the holes 30 simultaneously, using a plurality of rotating drill bits in a large drilling head, or a plurality of cylindrical punches. In either case, the drill bits or punches are aligned with cylindrical holes in a mated table surface which supports sidewalls 14 and 20 during the hole-making operation. Such holes should pass all the way through the table surface, so that drilled particles or punched pieces can be collected in a filter bag, basin, or other suitable device beneath the table.

If a punching operation is used, it preferably should remove a small circular piece of material, to create an open hole through the tire (comparable to a hole which has been drilled). This will facilitate assembly of numerous sidewalls into a culvert section. A simple cut (in a flat shape or in an X-configuration) which does not remove any material could be used to pass the holding bars 40 through the sidewalls, but that would generate unwanted pieces of distorted rubber which would press against the holding bars 40 after the culvert section is assembled. To avoid that problem, a drilling or punching operation which removes a small piece of material from each hole is preferred.

As indicated by FIG. 1, the holes 30 will allow the sidewalls 14 and 20 to be slid onto conformably spaced holding bars 40 which are mounted on a circular steel plate 42 having an annular shape with approximately the same planar dimensions as the sidewall sections. The rigid steel plate is referred to herein as a base plate 42, to distinguish it from closure plate 44 in one particular method of assembly.

The number and spacing of the holes 30 which pass through the sidewalls must conform and correspond to the number and spacing of the holding bars 40. However, the number of holes 30 and holding bars 40 can vary, depending on the size (both diameter and length) and intended use of a particular culvert segment. For short culvert segments (such as less than about 1.3 meters or 4 feet) having relatively small diameters (made from tires that normally fit on compact and subcompact cars), as few as two holes and two holding bars can be used, if they are spaced in diametric opposition and if the cross-sectional diameters of the bars are sufficient to provide adequate strength for the intended lifespan of the culvert. However, it is preferable to use at least three holding bars even in the smallest culverts, to provide greater stability and durability, and it is preferable to use even more holding bars (such as four to eight) in large diameter and/or long culvert segments (such as five to eight feet long). Accordingly, FIG. 1 shows six holes 30 and six holding bars 40, as an exemplary but not limiting configuration.

The term "bar" is used broadly herein, to refer to a relatively rigid or stiff elongated component which will pass between the two end plates when the culvert section has been assembled. No specific type of cross-sectional shape is implied, although the most convenient and least expensive bars will have circular cross-sections. In addition, no minimum degree of rigidity or stiffness is required, so long as the functional requirement is satisfied that all of the bars must be inserted through the holes in the sidewalls. This suggests that rigid bars probably will be preferable to steel cables in most situations; however, short segments of thick steel cable occasionally become conveniently and economically available (for example, they are frequently discarded after the installation of large facilities such as power line transmission towers). If such cable segments having sufficient thickness and stiffness to render them functionally equivalent to bars are used as described herein, such cables would be regarded as bars (or as their functional equivalent) as that term is defined and used herein.

Figure 2:
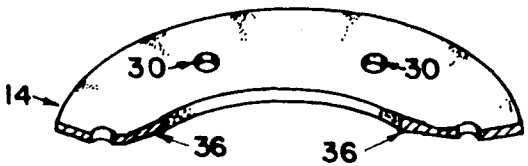
FIG. 2 shows a cross-section of a sidewall from a typical automobile tire, indicating the holes which have been drilled through the sidewall.
Figure 3:
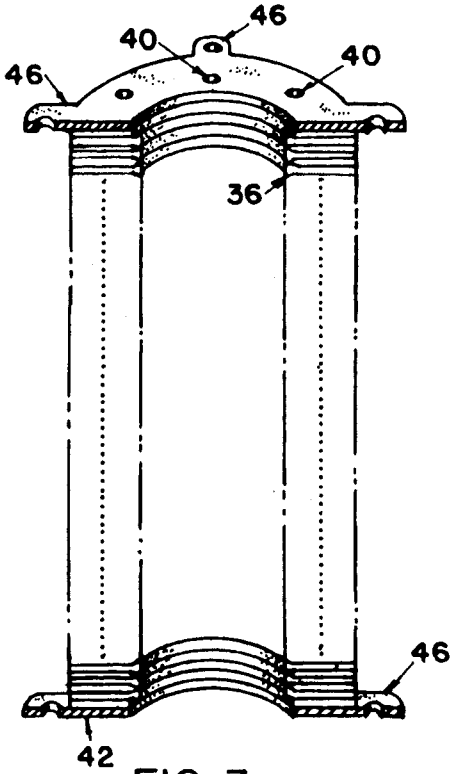
FIG. 3 shows a cross-sectional cutaway view of an assembled culvert section having multiple sidewalls held in place between a base plate and a closure plate.

FIG. 2 shows a cross-section of a sidewall 14, after holes 30 have been drilled or punched through it. This cross-sectional depiction shows the sidewall 14 in a relaxed configuration, before it has been flattened by pressure, as will occur when it is assembled into a culvert section. The cross-section comprises a main wall area 34, and an enlarged region 36 known as the "bead." Bead 36, which extends around the entire interior rim of the sidewall 14, normally helps to hold the tire securely in position on the rim of a wheel when the tire is in use on an automobile. This bead is substantially thicker (in cross-section) than the main wall area 38 of sidewall 14. Therefore, in order to allow a large number of sidewalls to be compressed together securely in a culvert section with maximal contact between them, the beads preferably should be cut out of at least some of the sidewalls that are gathered into a single culvert section. Although the cross-sectional dimensions of different brands and sizes of tires vary, a bead is typically about 2 to 3 times thicker than the main wall portion of a sidewall. Accordingly, the beads will need to be removed from at least half and possibly two-thirds of the sidewalls used in a culvert section.

Any suitable method can be used for bead removal. For example, if automated equipment is used to cut the tires, all beads can be removed as a routine process, using an automated cutting device. This can be done in either of two ways: (1) after the sidewalls have been cut off from the treaded portion, preferably while still being held in position by the cutting machine, or (2) after a number of sidewalls have been mounted on holding bars 40 on a base plate. If all beads are removed, this would increase the inside diameter of the culvert, thereby increasing its flow capacity. Alternately, the beads can be removed from only some of the sidewalls being treated (i.e., the entire bead is removed from any such sidewall, but only some of the sidewalls are treated by bead removal). Since many culverts do not need to provide a high flow capacity are only intended to avoid the problem of standing puddles of water, allowing beads to remain on some of the tires in culverts designed for such use will not diminish their utility.

When the desired number of beads have been removed and the sidewalls have been drilled or punched from a large number of sidewalls (such as at least 50), the sidewalls are mounted and stacked on base plate 42, by means of a stacking operation where holding bars 40 slide through holes 30. This mounting operation can be done while the base plate 42 is lying flat on a horizontal surface, so that holding bars 40 will be standing in a vertical orientation, to minimize stresses on the base plate 42 or bars 40 during assembly. Alternately, if heavy machinery is used to handle the sidewalls during the assembly process, the assembly can be done while the holding bars 40 are horizontal, provided that adequate support is provided for the bars to avoid sagging or bending.

When a suitable number of sidewalls have been stacked on a base plate 42, so that only a few inches of the upper ends of holding bars 40 are protruding above the top surface of the uppermost sidewall in the stack, a closure plate 44, which has an annular shape and which is equipped with holes that correspond to the placement of holding bars 40, is slid onto the exposed tips of the bars 40.

In one preferred closure means, a hydraulic or pneumatic press is then used to generate substantial downward pressure on the closure plate (such as in the range of about 10 to about 50 tons of total force), which should be distributed evenly around the entire closure plate. While that downward pressure is maintained, the exposed ends of the holding bars 40 are welded to the closure plate. After the welding is been completed, the pressure is released and the protruding tips of the holding bars 40 are cut off to provide a relatively flat surface.

This completes the assembly of a culvert section having a cylindrical shape with an open passageway through the cylinder.

In an alternate closure method, a significant length (such as several inches) of at least one end of each holding bar is threaded, and the closure plate is secured in position, pressing the rubber sidewalls tightly against each other and against the end plates, by tightening nuts on the threaded ends of the bars. This method has the disadvantage of creating a non-planar surface at the end of the culvert section, since the nut will remain in position, exposed on the outside of the end plate. However, that problem can be overcome by gluing or otherwise securing one of more rubber sidewalls to the end of the culvert section, wherein the end-cap sidewalls have holes which accommodate the exposed nuts and rise to a corresponding height. This method of closure offers the advantage of not requiring a hydraulic or pneumatic press during the assembly operation.

A plurality of sections can be assembled, using conventional earthmoving equipment, to create a culvert having any desired length beneath a road or embankment. When resting on its side, base plate 42 and closure plate 44 will function as end plates 42 and 44.

If desired, three or more protruding lugs 46 (which can also be called ears) can be positioned around the outer periphery of the plates, with holes or slots for coupling the plates together by means such as threaded bolts. If desired, one set of slots should be elongated in a radial direction, while the other set of slots can be elongated in a tangential direction, to facilitate insertion of the bolts through matched holes without requiring precise alignment of the holes.

If desired, one or two pieces of rubber sidewall (either with or without holes) can be inserted at each joint between two adjacent culvert segments, to provide a padded, elastomeric seal between the segments and to provide a deformable padding material to prevent pressing a rigid surface against the welds and the ends of the bars.

In addition to disclosing a method of assembling a culvert section, this invention discloses a new type of culvert as an article of manufacture, comprising a multiplicity of annular rubber-containing sidewall sections which have been cut from discarded tires and which are constrained between rigid plates, wherein the rigid plates are coupled to each other by means of a plurality of tension-bearing members which pass through holes in the rubber-containing sidewall sections and which are attached at their ends to the rigid plates.

If desired, the sequence of assembly can be modified somewhat. For example, the holding bars can be held securely in position horizontally, either by a holding device which grips the bars near the middle, or by an interior steel reinforcing plate which has been welded to the bars near the middle. Sidewall segments can be slid onto both projecting ends of the bars at the same time, preferably while keeping the weight on both sides of the holder or reinforcing plate roughly balanced. When the desired number of sidewall segments have been slid onto the bars, steel end plates are welded to the bars at both ends of the assembly.

The sidewalls of automobile tires usually range from about ¼ to ⅜ inch in thickness (about 0.5 to 1 cm). Therefore, since each tire will supply two sidewall, each linear foot of culvert will use about 15 to 25 tires, and a 10 foot culvert will use 150 to 250 tires. This can be quite helpful in getting rid of a major solid waste disposal problem.

If desired, one or more steel plates can be positioned in the interior of a culvert section, simply by sliding a plate having suitably positioned holes down onto the holding bars 42, between two sidewalls. Such interior plates can provide reinforcement, particularly for culverts which are likely to be subjected to deep placement or other conditions which might subject them to heavy transverse loads (transverse refers to the direction perpendicular to the main axis of the cylinder.)

If desired, curved culvert sections can be made by using various components such as wedge-shaped sidewall segments and either curved bars or flexible cables.

Neither the interior surface nor the exterior surface of the culvert sections described herein will be smooth; however, they don't need to be smooth in order to provide completely adequate performance as a culvert. Indeed, many culverts are made of corrugated metal (i.e., metal which has a deliberately rippled surface, with furrows and ridges running transverse to the main axis for reinforcing purposes).

Figure 4:
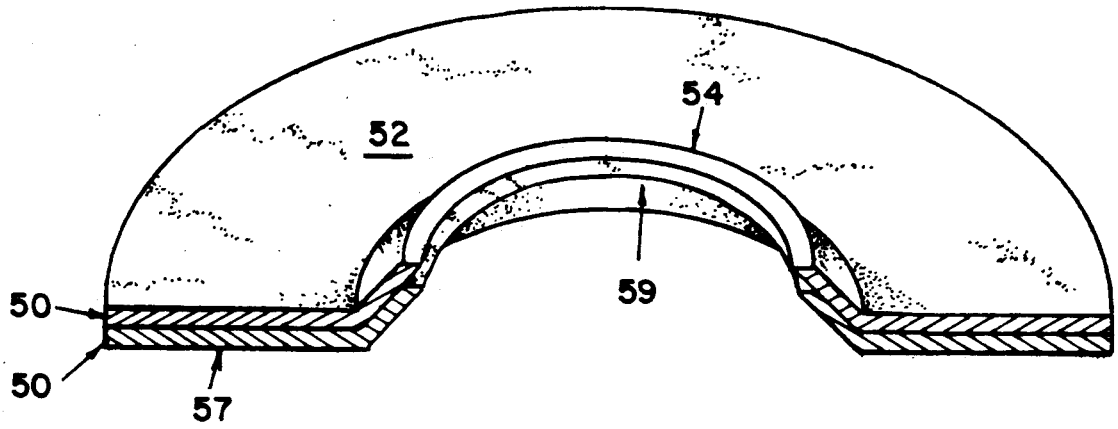
FIG. 4 shows two mated end plates having non-planar surfaces to help create a watertight fit between adjacent culvert sections when a culvert is assembled.

If desired, the end plates can be provided with offset rims or lips, to help align sections during the emplacement of a culvert string. Comparable mated surfaces are used in standard concrete piping sections, such as culverts and sewer pipe which have mated male and female rims. When steel plates are used, the mated surfaces can be simplified somewhat, compared to concrete rims, in a manner which would allow all plates with similar diameters to be manufactured using a single process. For example, as shown in FIG. 4, both of the mated plates 50 and 55 have identical shapes. Plate 50 has a flat component 52 in the dominant plane, and an offset rim 54 which functions as the female member when two culvert sections are strung together end-to-end. Plate 55 has an identically sized flat component 57, and an offset rim 59 which is partially inserted into rim 54 when plates 50 and 55 are pressed together as shown.

It should be pointed out that even though steel is used in the culverts described herein, the steel plates 42 and 44 and the holding bars 40 are almost entirely hidden and protected by the rubber material which comprises the bulk of the culvert. Accordingly, the steel plates and holding bars will last for much longer times than culverts made of exposed corrugated steel. The long lifespan of culverts made from scrap tires is of potentially major economic benefit, since it is very expensive to dig up an entire section of road in order to replace a corroded culvert beneath it.

It should also be noted that a hydrophobic sealing compound comparable to tar can be painted or otherwise coated onto the interior and/or exterior surface, or over any exposed steel surfaces such as lugs, bolts and nuts used to hold two adjacent sections together.

Any type of automobile tire, truck tire, or other large tire can be used as described herein, although not necessarily in a single culvert. For example, tires from 18-wheel trucks can be used to create moderately large culverts, while tires from earthmoving or construction equipment or large airplanes can be used to create even larger culverts.

In addition, sidewalls from automobile or truck tires can be cut into two or possibly three circular segments (and up to four or five segments for very large earthmoving tires). These segments can be size-sorted and used to make culverts having different diameters. In addition to providing more culverts, this will reduce the weight of each culvert.

Figure 5:
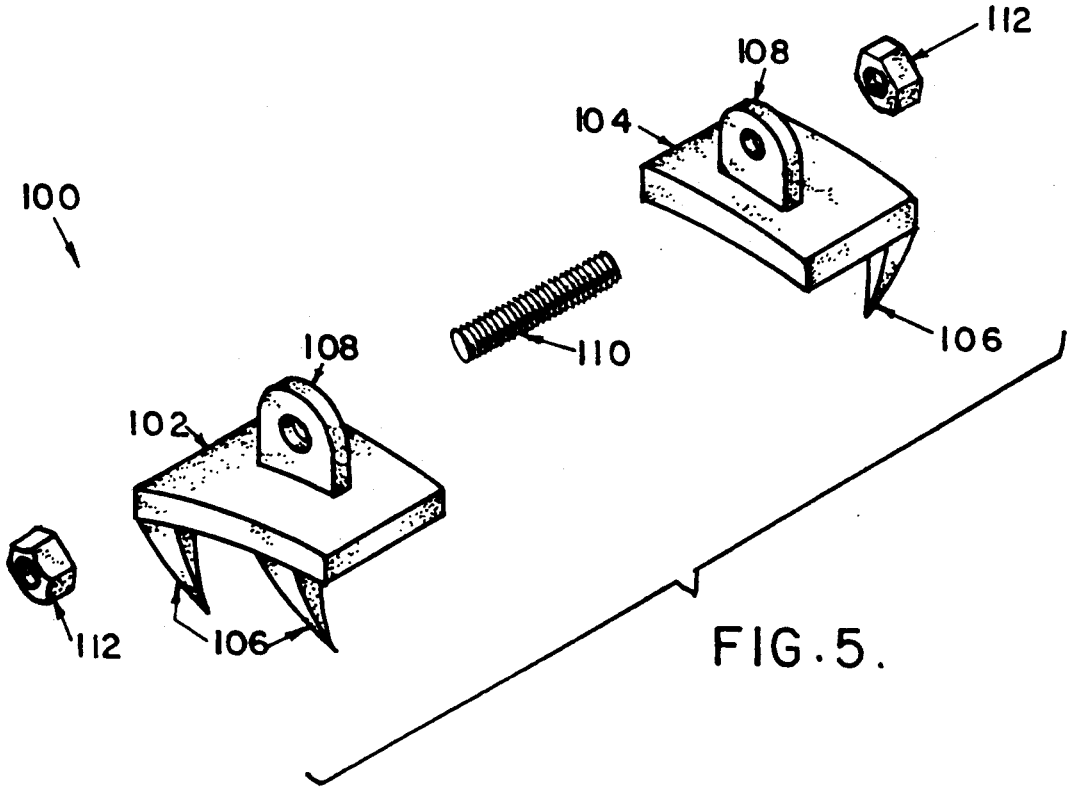
FIG. 5 is a depiction of a clamping device with claw-type grips that can be used to hold two adjacent culvert sections together, and which can be retrofitted onto a culvert if the exposed steel of the end plates becomes corroded.

In addition, the lifespan of the culverts of this invention can be extended even more by means of clamping devices which can be retrofitted to the culverts of this invention if any exposed steel connecting devices become corroded to the point of breakage. One such clamping assembly 100 is shown in FIG. 5. It consists of two main pieces 102 and 104, each of which comprises at least one and preferably two or more pointed claws 106 which will dig into the rubber sidewall material of the culvert. Pieces 102 and 104 contain protruding lugs 108, so that an elongated threaded bolt 110 can be passed through the lugs 108 and tightened using nuts 112. If desired, the initial placement and gripping step can be carried out by loosening or removing either or both nuts 112 and hammering the points of claws 106 into the compressed rubber in each of two adjacent culvert sections. When ready, the clamp assembly 100 is tightened and firmly secured by using a wrench to tighten nuts 112 on threaded bolts 110. This pulls the two pieces of the clamp toward each other, which tightens the joint between two adjacent culvert sections.

Thus, there has been shown and described a method for using discarded tires to manufacture culverts. This invention provides a useful and economic answer for a major solid waste problem, and it provides culverts which are exceptionally durable. Although this invention has been described with reference to certain exemplary embodiments, it will be apparent to those skilled in the art that various changes and modifications to the specific embodiments described herein are possible. Any such changes that do not depart from the spirit and scope of the invention are deemed to be covered by the invention, which is limited only by the claims which follow.

I claim:

1. An article of manufacture, comprising a multiplicity of annular rubber-containing sidewall sections which have been cut from discarded tires and rigid plates constraining said sections said rigid plates having annular shapes to form a cylinder with an open channel passing through its length, wherein said rigid plates are coupled to each other by means of a plurality of tension-bearing members which are rigidly attached to each end plate and which pass through holes in the rubber-containing sidewall sections.

2. The article of manufacture of claim 1, wherein each rigid plate is coupled to at least three tension-bearing members which are spaced in an equidistant manner around the rigid plate.

3. The article of manufacture of claim 1, wherein each rigid plate is equipped with at least one lug around the external periphery in a manner which allows two rigid plates coupled to adjacent and abutting cylinders to be secured to each other, thereby connecting two cylinders to each other to form a longer cylinder.

4. The article of manufacture of claim 1 wherein each rigid plate comprises a flat annular component in a dominant plane and an offset rim which does not remain in the dominant plane, thereby promoting a watertight mated alignment of adjacent rigid plate when two cylindrical sections are pressed against each other end-to-end.

* * * * *